US008545937B2

(12) United States Patent
Kosovich et al.

(10) Patent No.: US 8,545,937 B2
(45) Date of Patent: Oct. 1, 2013

(54) SPRAY COATING WITH UNIFORM FLOW DISTRIBUTION

(75) Inventors: Deborah S. Kosovich, Grafton, OH (US); Tammy J. Burtscher, Cleveland, OH (US)

(73) Assignee: Nordson Corporation, Westlake, OH (US)

( * ) Notice: Subject to any disclaimer, the term of this patent is extended or adjusted under 35 U.S.C. 154(b) by 1066 days.

(21) Appl. No.: 12/550,653

(22) Filed: Aug. 31, 2009

(65) Prior Publication Data

US 2011/0052806 A1 Mar. 3, 2011

(51) Int. Cl.
*B05D 7/22* (2006.01)

(52) U.S. Cl.
CPC ..... *B05D 7/22* (2013.01)
USPC ..... 427/233

(58) Field of Classification Search
USPC ..... 427/233; 239/225.1–265
See application file for complete search history.

(56) References Cited

U.S. PATENT DOCUMENTS

| | | | | |
|---|---|---|---|---|
| 3,640,758 | A | 2/1972 | Hogstrom et al. | |
| 3,697,313 | A | 10/1972 | Stumphauzer et al. | |
| 3,726,711 | A | 4/1973 | Hogstrom | |
| 3,754,710 | A * | 8/1973 | Chimura | 239/597 |
| 4,186,225 | A | 1/1980 | Smith et al. | |
| 4,346,849 | A | 8/1982 | Rood | |
| 4,378,386 | A | 3/1983 | Rehman | |
| 5,494,226 | A | 2/1996 | Herstek et al. | |
| 6,592,058 | B2 | 7/2003 | Kassanits | |
| 6,612,509 | B2 | 9/2003 | Holmstrom | |
| 6,742,730 | B2 | 6/2004 | Kassanits | |
| 2009/0230221 | A1 | 9/2009 | Ballu | |

FOREIGN PATENT DOCUMENTS

| | | |
|---|---|---|
| JP | 50-056658 | 5/1975 |
| WO | 2005/115633 | 12/2005 |

OTHER PUBLICATIONS

International Search Report dated Nov. 17, 2010, for International Application No. PCT/US2010/044990.
Written Opinion dated Nov. 17, 2010, for International Application No. PCT/US2010/044990.
Amendment Under Article 34 filed on Jun. 29, 2011, for International Application No. PCT/US2010/044990.
International Preliminary Report on Patentability for International Application No. PCT/US2010/044990 dated Feb. 16, 2012.

* cited by examiner

*Primary Examiner* — William Phillip Fletcher, III
(74) *Attorney, Agent, or Firm* — Calfee, Halter & Griswold LLP

(57) ABSTRACT

A spray nozzle is disclosed that produces a flat spray pattern for liquid coating material, the spray pattern having a generally uniform flow distribution of quantity of coating material across the spray pattern. The spray nozzle may include a rectangular cut spray orifice to produce such a spray pattern. The spray pattern may further have distinct edges so that the pattern exhibits substantially reduced tailings of coating material outside these edges. In one embodiment, the spray pattern produces a "rectangular" drip pattern. In another embodiment, the spray pattern may include a middle region having reduced flow of coating material as compared to side regions of the spray pattern.

16 Claims, 9 Drawing Sheets

FIG. 12
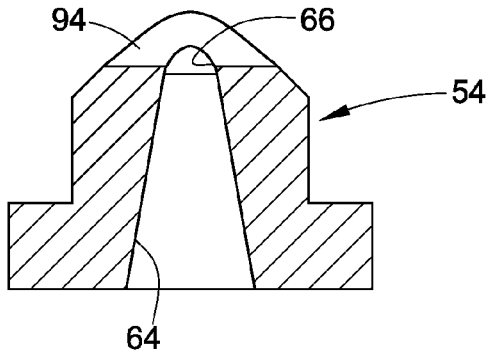
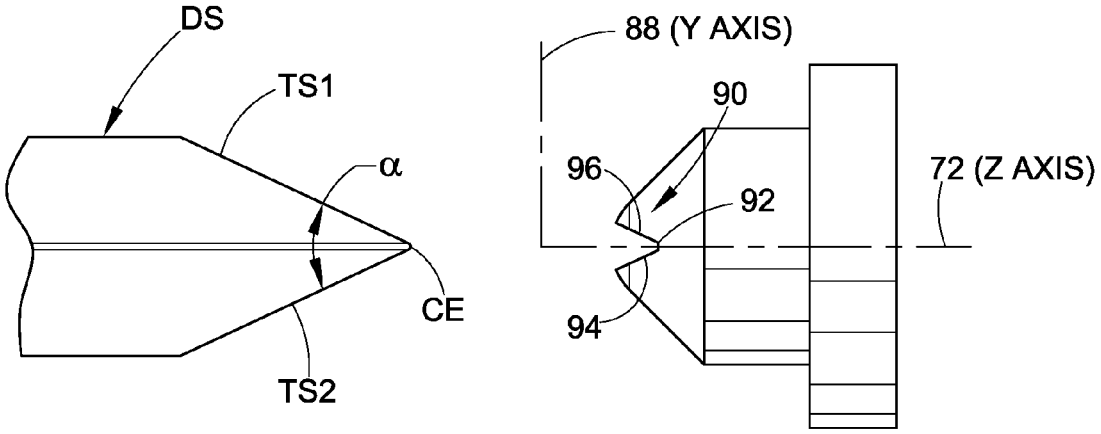
FIG. 13
FIG. 14
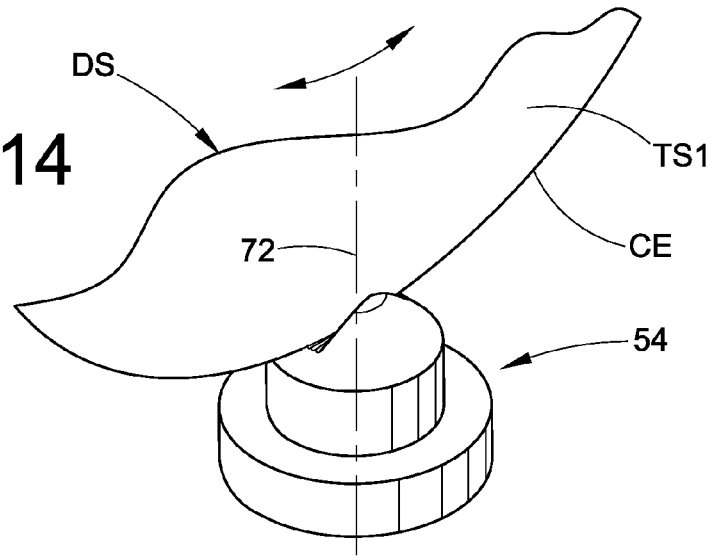

SPRAY COATING WITH UNIFORM FLOW DISTRIBUTION

BACKGROUND

Various methods and apparatus are used today to coat the interior surfaces of cylindrical objects, such as, for example, metal cans and containers used in the food and beverage industries. These coatings are typically applied in liquid form by spraying from an airless or air assisted spray nozzle through an open end of the container. Some spraying methods use more than one spray nozzle. The coatings are used to protect the food and drink contents of the container from the metal.

Such containers are typically two piece or three piece. In a two piece can, the can body may be a deep drawn cylinder with a closed end. A second piece is applied in a final operation to close the can after the contents have been added. In a three piece can, the cylindrical body or shell is open ended at both ends and further includes separate top and bottom end discs. The bottom end disc may be added prior to the coating operation much like a two piece can, and then the top end disc added to close the can after the contents have been added. However, double open ended can bodies or shells may also undergo separate coating operations, for example with a single nozzle at one open end or two nozzles at one open end or a single nozzle at each open end.

The inside surface profile or contour of such cans may vary from being completely smooth, to including contoured portions such as ribs for example or other contours or shapes. Also, the shape and profile of the bottom end disc may present additional challenges in assuring that the entire interior surface is adequately coated, particularly at the seam between the cylindrical sidewall and the outer edge of the bottom end disc. These complexities have led to a variety of spray nozzles to produce spray patterns that will result in adequate coating while attempting to minimize overspray. Overspray may be observed either as excessive coating material being applied to assure adequate coverage, loss of overspray material outside the can body when attempting to coat near the can body exterior edges, or both.

Typical spray patterns used for coating can interior surfaces are flat fan patterns. These flat fan spray patterns may include symmetrical spray patterns having maximum flow of the coating material in the middle with gradual diminished flows tapering or "feathering" from the middle to the ends of the pattern. Such a typical symmetrical pattern is illustrated herein with FIG. 2. Other flat fan spray patterns include asymmetrical or "controlled distribution" patterns such as produced by "drumhead" nozzles, in which the flow distribution is heavily skewed to one end or side of the spray pattern. Examples of nozzles used to produce flat fan spray patterns including drumhead nozzles are described in U.S. Pat. Nos. 3,640,758; 3,697,313; 3,726,711; 4,346,849 and 4,378,386, the entire disclosures all of which are fully incorporated herein by reference. These patents also provide excellent background information for various spraying methods and apparatus for single nozzles, two nozzles, spraying from one open end, spraying from two open ends and so on. These methods and apparatus are well known to those skilled in the art and therefore need not be repeated herein.

Spray coating processes for containers take into consideration two basic criteria. The first is the total weight of coating material used in the coating operation. The total weight significantly impacts overall cost. Total weight is a combination of overspray that is lost outside the container—for example when spraying near the outside edges of the side wall—and the quantity of material that is applied to the interior surfaces. The second important criteria is coating thickness and coverage. While adequate coating may be applied to assure sufficient thickness and coverage, from a cost and time standpoint it is wasteful to overcoat the container. Also, some surface areas may be more critical than others in specific applications and so it is not uncommon to overcoat less critical areas in order to assure adequate coverage of the critical areas. Coating processes are thus targeted to balance adequate coverage and coating thickness within a desired total weight goal, while trying to minimize overspray outside the container.

SUMMARY

The disclosure presents a number of inventions and inventive aspects relating to spray coating methods and apparatus for coating interior surfaces of cylindrical bodies or containers such as can bodies with liquid coating material. In accordance with a first inventive aspect presented in this disclosure, a coating method may include producing a spray pattern that exhibits a generally uniform or generally even flow distribution of coating material across the spray pattern. In an exemplary embodiment of a coating method, the spray pattern may be used to coat an interior generally cylindrical surface of a metal can.

In accordance with another inventive aspect presented in this disclosure, a spray pattern with a generally uniform or generally even flow distribution of coating material across the spray pattern may be a generally symmetrical flat spray pattern, and may further include distinct edges such that tailings or feathering are substantially reduced outside these spray pattern edges. In an exemplary embodiment, such a spray pattern may be used to coat a cylindrical interior surface of a container up to an outside or open edge of the surface with substantially reduced overspray or loss of material outside the cylindrical container body. In another exemplary embodiment, the spray pattern produces a generally "rectangular" shaped drip pattern.

In accordance with another inventive aspect presented in this disclosure, a flat spray pattern with a generally uniform or generally even flow distribution of coating material across the spray pattern may further exhibit a portion of the spray pattern having a reduced flow of coating material. In an exemplary embodiment, the reduced flow portion may be exhibited in a middle region of a generally symmetrical spray pattern, as compared to the flow of the coating material in side regions of the spray pattern.

Additional inventive aspects presented in this disclosure include a spray nozzle design having a generally rectangular shape cut spray orifice that produces a spray pattern with a generally uniform or generally even flow distribution of coating material across the spray pattern, including methods of making such a spray nozzle spray orifice. In an alternative embodiment, a spray nozzle design may include a generally rectangular shape cut spray orifice that produces a spray pattern with a generally uniform or generally even flow distribution of coating material across the spray pattern and further exhibiting a portion of the spray pattern having a reduced flow of coating material, including methods of making such a spray nozzle. In an exemplary embodiment of a spray nozzle having a generally rectangular shape cut spray orifice to produce a generally uniform flow distribution of coating material across the spray pattern and further exhibiting a portion of the spray pattern having a reduced flow of coating material, the generally rectangular shape cut spray orifice may include enlarged end portions, or alternatively a reduced dimension central portion. Additional inventive aspects include coating methods for cylindrical interior surfaces such as for metal cans, for example, using one or more of the exemplary spray patterns and spray nozzles.

These and other aspects and advantages of the inventions disclosed herein will be understood by those skilled in the art from the following detailed description of the exemplary embodiments in view of the accompanying drawings.

BRIEF DESCRIPTION OF THE DRAWINGS

FIG. 12 is a longitudinal cross-section of the spray nozzle tip of FIG. 10 along the line 12-12;

FIG. 13 is a profile of the spray nozzle tip of FIG. 10, also showing an exemplary diamond cutting saw DS;

FIG. 14 is a perspective of a diamond cutting saw in position for a cutting operation to form an spray orifice such as illustrated in FIG. 7;

BRIEF DESCRIPTION OF THE EXEMPLARY EMBODIMENTS

Figure 1A:
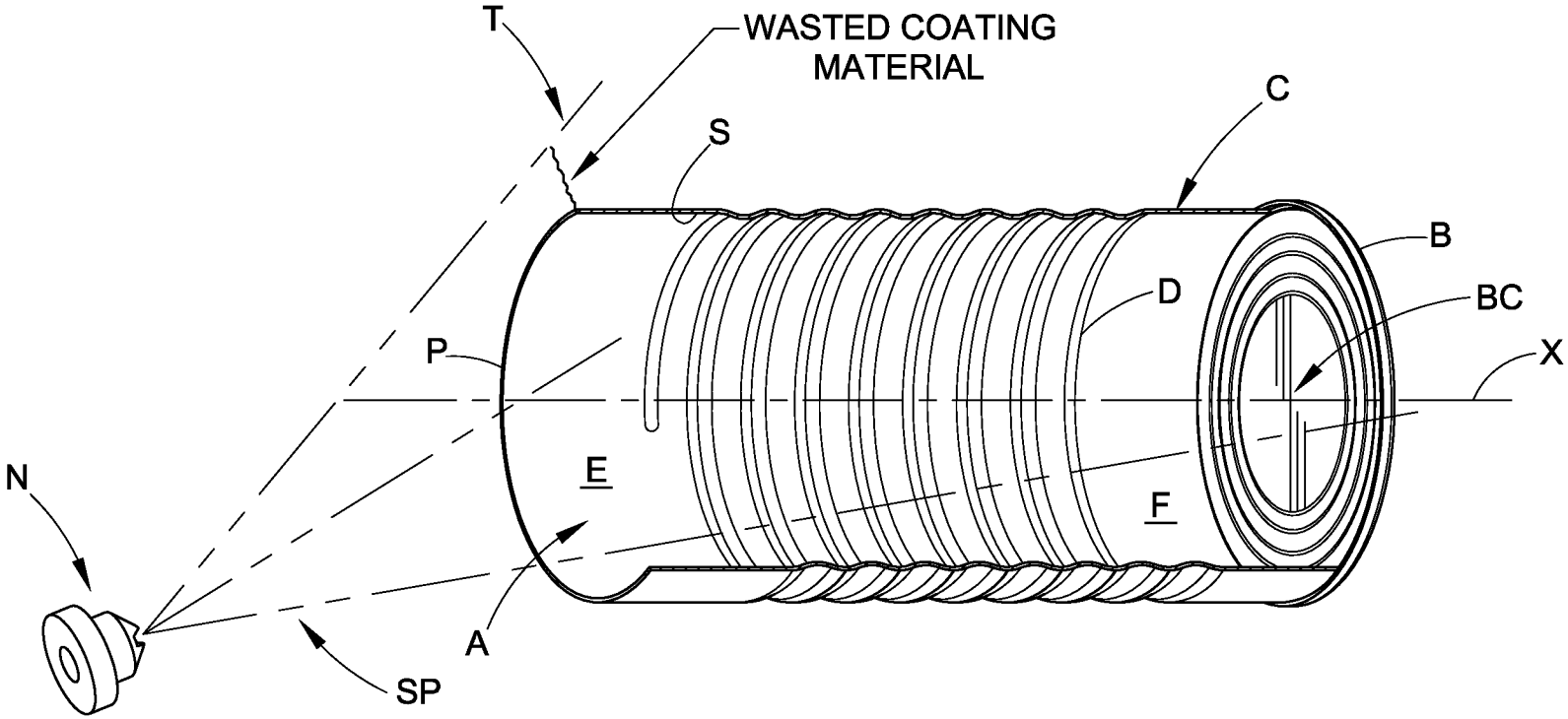
FIG. 1A (PRIOR ART)
FIG. 1A is a schematic representation of a prior art coating method using a spray pattern such as illustrated in FIG. 2, with the container shown in longitudinal cutaway side view.

The present disclosure is directed to apparatus and methods for applying liquid coating material to the interior surface of a cylindrical body or container, such as, for example, a metal can body. By liquid coating material is meant any material that may be applied to the interior surface, typically to protect the contents from deleterious effects caused by contact with the metal material of the container. A liquid coating material may include, for example, a solid suspension in a solvent or other liquid carrier. Although the exemplary embodiments herein are directed to the use of a spray pattern for coating containers, and particularly interior surfaces of open end cylindrical bodies, the inventions may find use and application in other coating processes where the characteristics of the spray patterns that are some of the inventive aspects presented herein may be advantageous over other spray patterns. For example, the inventions are not limited to use in coating interior surfaces, cylindrical surfaces or metal surfaces. The present inventions are not limited to any particular spray equipment or technique, although some of the inventive aspects herein relate to the nozzle tip and spray orifice used to produce the novel spray pattern characteristics. Although the exemplary embodiments herein illustrate a coating process for a two piece can body having a single open end, the inventions may also be conveniently used for three piece can bodies or for coating cylindrical bodies with two open ends. Furthermore, although the exemplary embodiments illustrate airless spray nozzles, the inventions may be used with air assisted nozzles as well.

While various inventive aspects, concepts and features of the inventions may be described and illustrated herein as embodied in combination in the exemplary embodiments, these various inventive aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

With reference to FIG. 1A, an open end cylindrical body such as a typical food or beverage container such as a metal can C is illustrated in a cutaway side view. Such containers C may be two piece or three piece structures as are well known in the art, and usually include a generally cylindrical interior surface or side wall S having a central longitudinal axis X. An end disc B may be integrally formed with the cylindrical side wall S such as during a deep draw process for a two piece can, or may be attached such as by welding for a three piece can.

The cylindrical sidewall S may alternatively be formed from flat sheet in which case it will also exhibit a longitudinal seam formed by a butt weld or lap weld operation (not shown). Although FIG. 1A illustrates a typical two piece can body with a single open end A, the inventions may be used with double open ended container bodies, as well as three piece cylindrical container bodies.

The generally cylindrical interior surface or side wall S of the exemplary can body C of FIG. 1A may include a central portion D that is ribbed, as is typical with food containers, and on either side of the ribbed central portion D, two end portions E and F that may be generally smooth (middle portion and end portions being referenced for convenience along the axis X). Other side wall profiles and shapes and contours may be used, including a cylindrical sidewall having an interior surface that is completely smooth, as is common with beverage cans for example. The end disc B may typically be a generally flat disc having a center BC where the longitudinal axis X intersects the end disc.

Figure 2:
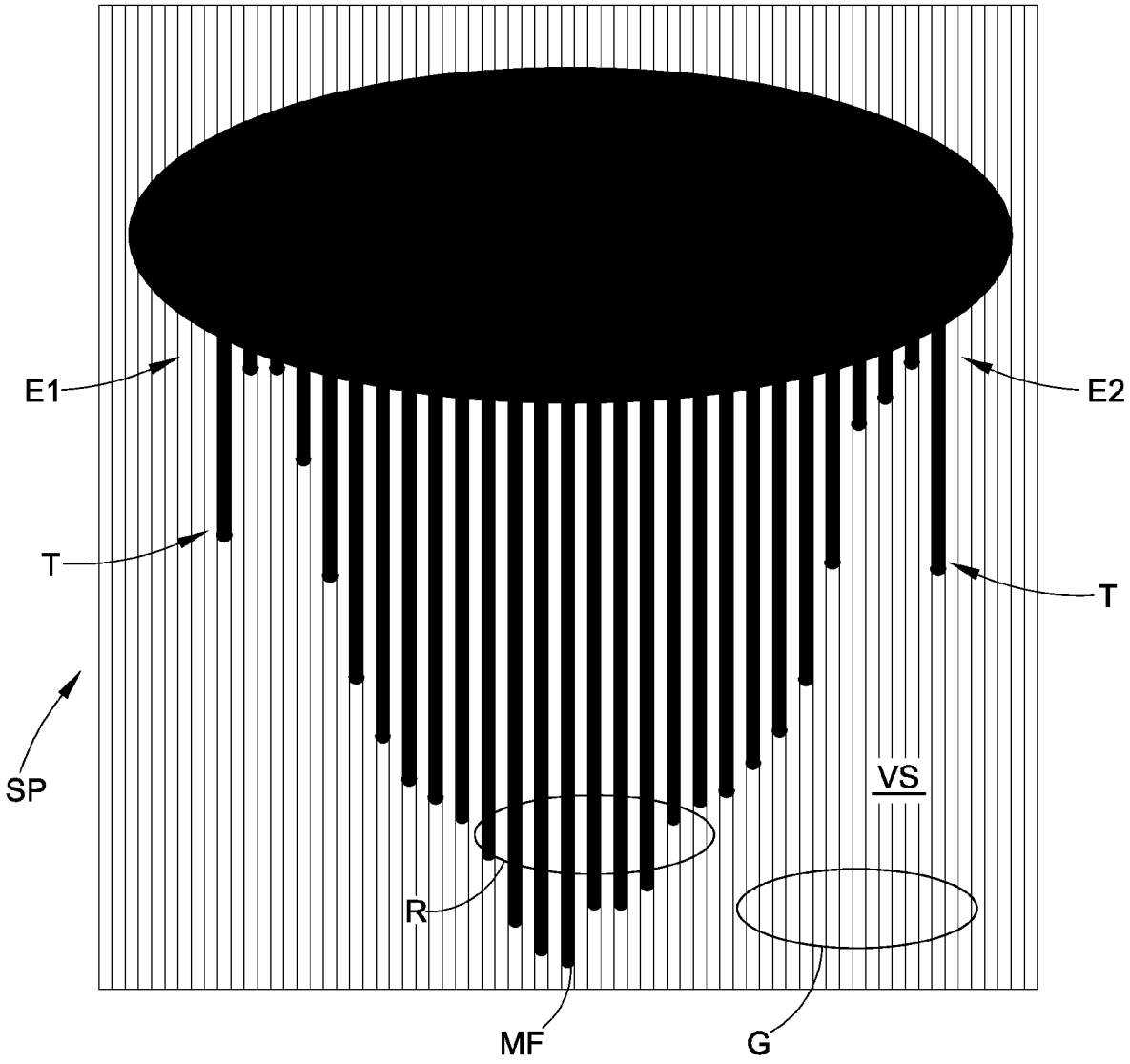
FIG. 2 (PRIOR ART)
FIG. 2 is a simplified representation of a typical drip pattern for a flat fan spray pattern of the prior art.

The exemplary can body C having ribs and smooth portions is chosen for illustrative purposes to explain some of the benefits that may be derived from use of the spray pattern concepts taught herein. Reference should also be made to FIG. 2 which illustrates a typical prior art flat fan spray pattern used to apply coating material to the generally cylindrical interior surface S.

FIG. 2 is referred to herein as a drip pattern for convenience. This is a common method for gauging the distribution of flow of coating material from a particular spray nozzle. The method may include spraying a short burst of coating material against an upright, vertical substrate VS with the spray pattern oriented with its long axis horizontal. The substrate VS may include alternating lands and grooves, as in a corrugated sheet, to offset the effect of adverse influences such as blast from the spray gun that may cause washout or distortion of the true spray pattern. The quantity of coating material sprayed on any particular area (and hence an indicator of the flow of coating material across the spray pattern) will be reflected by the length, longer or shorter, of the drip lines or rivulets R in the grooves G running vertically downward beneath it.

For the illustrated spray pattern of FIG. 2, the oval area at the top of the pattern is the target of impact of the fan spray pattern with the corrugated sheet or substrate VS. It will be noted that the longest line of flow MF occurs about in the middle of the spray pattern, with several adjacent lines on either side being about as long. The longest lines, and in particular the longest line MF represent the location (i.e. distribution) in the spray pattern of maximum flow of the coating material. It will be further noted that the overall spray pattern is generally symmetrical about the middle of the spray pattern which exhibits the maximum flow. The spray pattern further exhibits the characteristic that the flow of coating material is smoothly but not generally evenly or uniformly distributed, and thus gradually diminishes to the ends of the spray pattern E1 and E2. However, out at the ends it will be observed that there are significant flow portions, called tailings or feathering T. These tailings represent possible overspray issues as further explained below. The spray pattern of FIG. 2 is a typical prior art symmetrical flat fan spray pattern produced by a spray nozzle spray orifice that is symmetrical and basically formed by a V-shaped notch through a hemispherical dome, as will be further illustrated below.

Consider now a spray coating operation for the cylindrical interior surface S of the can body C of FIG. 1A, using a spray pattern such as in FIG. 2. For some can manufacturers, the smooth portions E and F of the generally cylindrical interior surface S may be viewed as critical areas to coat. This is because with a typical symmetrical spray patter such as in FIG. 2, much of the flow distribution is in the center of the spray pattern. One or more spray nozzle tips N may be used to produce a spray pattern SP. For the moment we consider the spray pattern SP to be such as shown in FIG. 2. Because the flow distribution of coating material in the spray pattern SP is mainly concentrated in the middle of the spray pattern, the spray pattern will be directed so as to coat the central portion D of the cylindrical interior surface. If the nozzle is stationary, sufficient material will need to be sprayed so as to assure adequate coating of the end portions E and F. This may not only result in over spraying the central portion D with too much material, but also the tailings T may well extend beyond the outer edge P of the can body open end A, and thus outside the interior volume of the can and be wasted. This is especially the case if the nozzle tip N is lanced or moved so as to coat the interior surface S up to or near the outer edge P of the can body, because most of the material flow is near the center of the spray pattern. Thus, especially for cases where the end portions D and E are considered to be as critical as the central portion D, excessive material (i.e. weight or quantity) may be applied in order to assure adequate coverage and thickness of all areas of the interior surface S, accompanied by substantial loss of coating material to waste outside the can body due to the tailings and the gradually diminished flow towards the end regions of the spray pattern.

Figure 3:
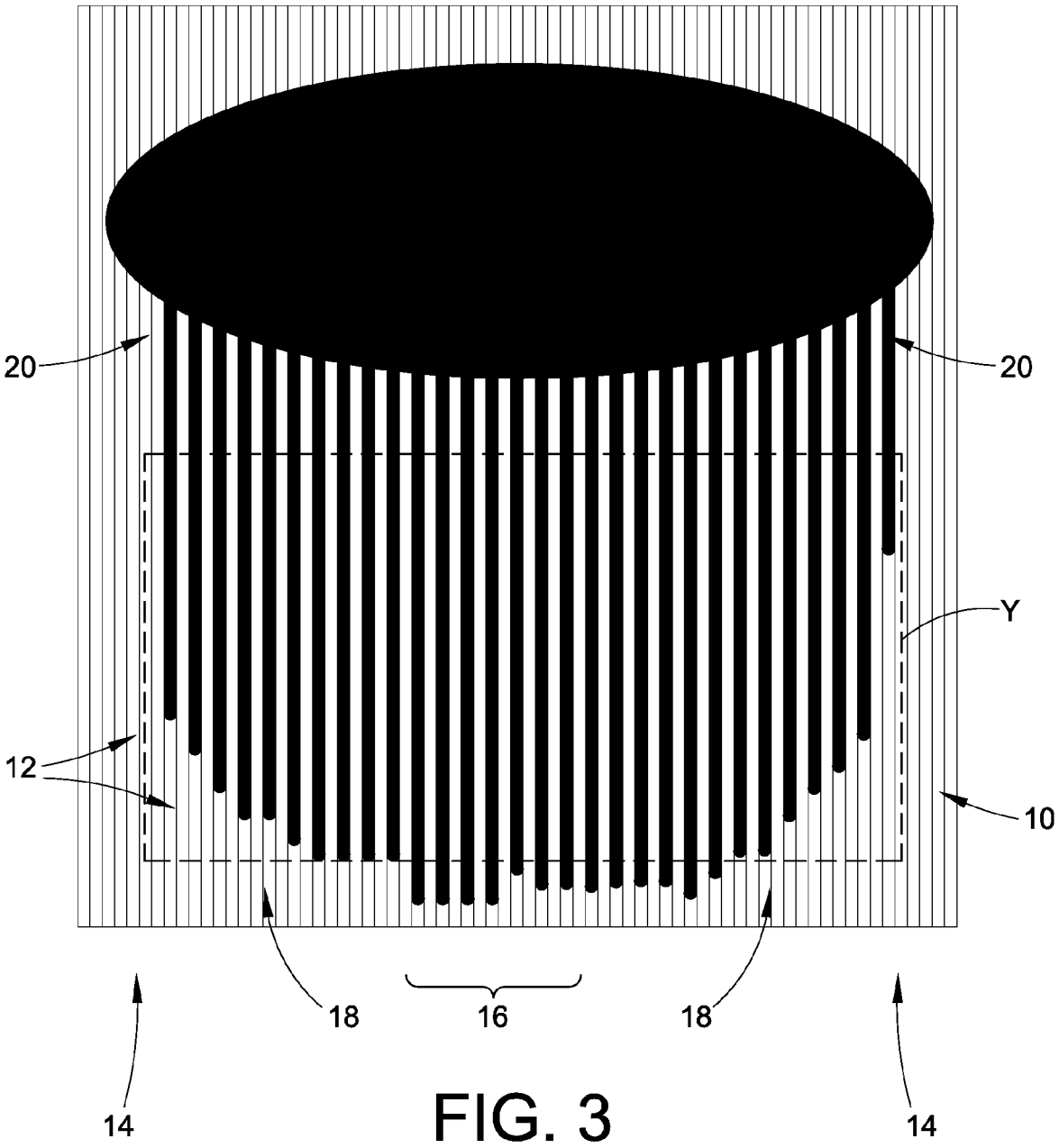
FIG. 3 is a simplified representation of a drip pattern for a rectangular shape spray pattern in accordance with one or more of the present inventions.

Turning next to FIG. 3, we illustrate a spray pattern 10 in accordance with one or more of the inventions presented in this disclosure. To fully appreciate the significant differences between the spray pattern 10 and the spray pattern SP of the prior art (FIG. 2), the figures may be viewed side by side. The first readily apparent difference is that the spray pattern 10 of FIG. 3 has a generally uniform or generally even flow distribution of coating material across the spray pattern 10. The various drip lines 12 extend down about the same distance, indicating that the quantity of coating material in each groove is about the same. Thus, the middle region 16 of the spray pattern does not contain a significantly heavier distribution of coating material or flow, nor any more than most of the rest of the spray pattern 10 out to the side regions 18. The spray pattern 10 is a flat spray pattern and is generally symmetrical. But the spray pattern 10, as a result of its generally uniform or generally even distribution of coating material across the spray pattern, has a generally rectangular shaped appearance, in distinct contrast to the somewhat rounded conical or bullet shape of the prior art spray pattern SP of FIG. 2. We thus herein refer to the spray pattern 10 as being a rectangular pattern, in that there is generally uniform or even flow distribution across the spray pattern with rather distinct edges or edge regions 14 of demarcation of the generally uniform flow distribution of the coating material (being a generally flat spray pattern, there are two such distinct edges or boundaries of the spray pattern 10, 30, identified as 14*a* and 14*b* in FIG. 1B). This is in considerable and distinguishable contrast to the prior art spray pattern SP of FIG. 2 that does not have such distinct edges of generally uniform flow distribution, but rather has a gradually diminishing flow distribution. Further note that the tailings or feathering characteristics 20 of the spray pattern 10 have been greatly diminished and in some nozzle designs may be all but eliminated as to any meaningful flow. We draw approximated lines Y to highlight the generally rectangular shape of the spray pattern 10 relative to the generally uniform or even flow distribution across the spray pattern from side region to side region 18 and through the middle region 16. Such a rectangular shape cannot be superimposed on the prior art spray pattern of FIG. 2, for example, due to the centrally heavy flow distribution and gradually diminishing flow distribution towards the ends of the spray pattern SP.

Figure 1B:
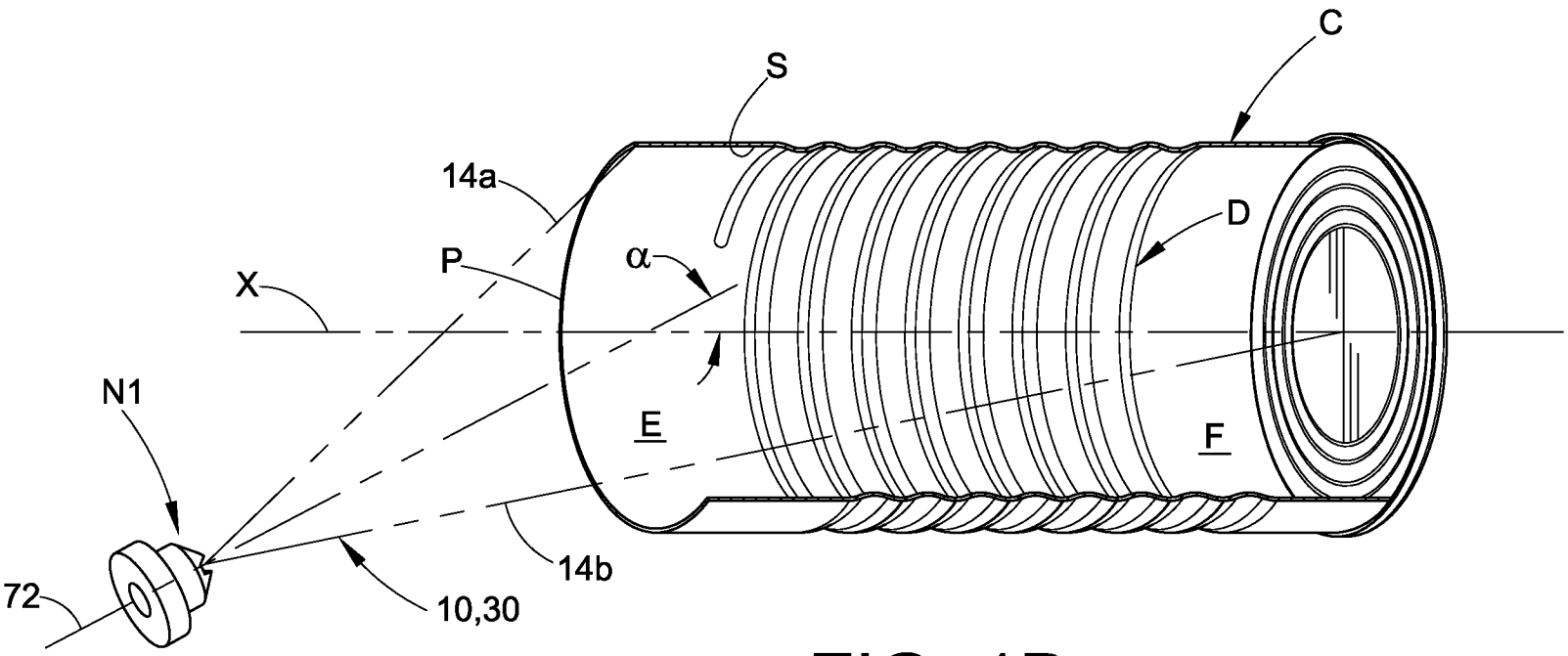
FIG. 1B is a schematic representation of a coating method using a spray pattern such as illustrated in FIGS. 3 or 4, with the container shown in longitudinal cutaway side view.

Consider now the use of the spray pattern 10 for coating the generally cylindrical interior surface S of the can body C of FIG. 1B. The generally even flow distribution across the spray pattern 10 (using, for example, the spray pattern 10 of FIG. 3 or the spray pattern 30 of FIG. 4) assures that adequate coating material will be sprayed onto the central portion D as well as the first and second side portions E and F of the generally cylindrical interior surface S. The generally even flow distribution allows better control of the thickness of the material, as well as controlling the total weight of material to achieve those target thicknesses, with substantially reduced overspray. Moreover, the well-defined edges 14 of the spray pattern 10 will allow the spray pattern to be positioned up to the outside edge P of the can body, if so desired, with substantially reduced loss of material outside the can body interior. As illustrated in FIG. 1B, one edge 14*a* of the spray pattern 10 produced by a nozzle tip N1 may be directed to the top edge 15 of the cylindrical can body and the other edge 14*b* may be directed to the center BC of the end disc B. The distinct edge 14*a* allows spraying up to the outside open edge P of the cylindrical body C with little overspray outside the cylindrical body interior, because the generally even flow distribution also has substantially reduced tailings. The angle $\alpha$ is the acute angle between the central longitudinal axis X of the cylindrical body C and the central axis (72) of the spray nozzle tip N1, and the angle $\alpha$ may be selected based on the size of the cylindrical body C, size of the nozzle spray pattern 10 and so forth.

Figure 4:
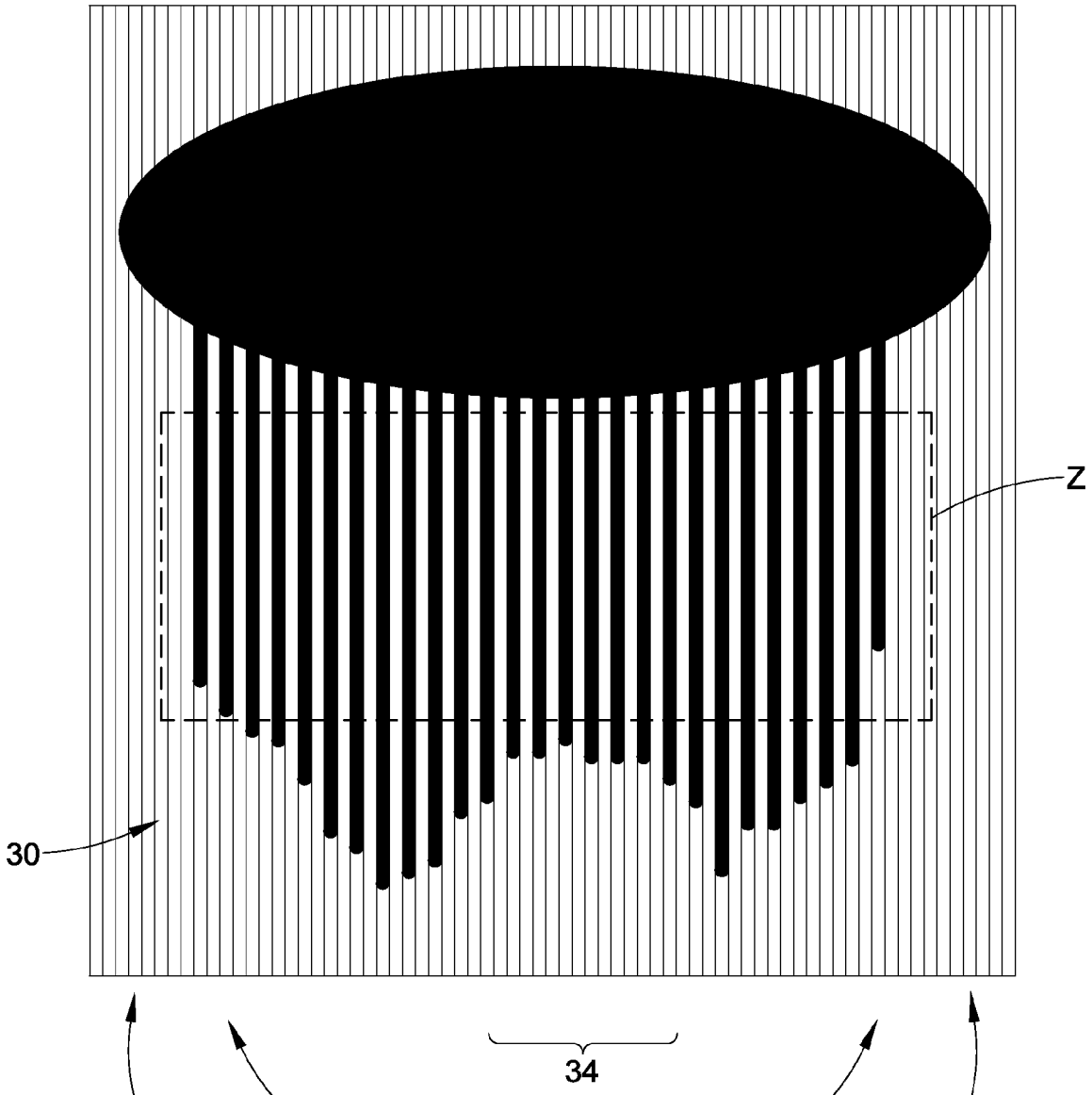
FIG. 4 is a simplified representation of a drip pattern for an alternative embodiment of a rectangular shape spray pattern in accordance with one or more of the present inventions.

Turning now to FIG. 4, we show an alternative embodiment of the rectangular shaped spray pattern 30. This spray pattern 30 has many of the characteristics of the spray pattern 10 of FIG. 3, including that it is a flat spray pattern with a generally uniform or generally even flow distribution of coating material across the spray pattern 30, thus presenting or exhibiting a generally rectangular shape—as outlined with the lines Z—with well defined edges 32 of the pattern. Like the spray pattern 10 of FIG. 3, the spray pattern 30 also exhibits substantially reduced flow beyond the edges or edge regions 22, thus resulting in minimized or substantially reduced tailings or feathering as compared to the prior art spray patter SP of FIG. 2.

However, in addition to the generally even flow distribution across the spray pattern 30, the spray pattern further includes a middle region 34 having a noticeably reduced flow distribution, as compared to the flow distribution towards the side regions 36 of the spray pattern. We still refer to the overall spray pattern as having a generally rectangular shape due to the generally even flow distribution from side region to side region 36 across the spray pattern, but the pattern further includes the middle region 34 of reduced flow. This allows a controlled spray pattern 30 that directs more material to the side regions 36, for example to assure adequate coating of the smooth end portions E and F of the can body of FIG. 1B. This may be desirable, for example, where more material weight or thickness of the coating is desired over the end portions E and F than the central portion D, and moreover, avoiding having to overspray the central portion D simply to achieve the desired thickness and weight at the end portions E and F. The overall effect allows for achieving a desired weight distribution of the coating, for example to have different portions of the cylindrical interior surface to have different thickness, without having to have overspray and ending up with more coating material weight overall than was needed. The spray pattern 30 orientation may be implemented, for example, in a manner similar to FIG. 1B described herein above.

Both spray patterns 10 and 30 (FIGS. 3 and 4) may be used for a coating operation using one or two nozzles, for example, and can be applied to double open ended can bodies or single open ended can bodies. For the spray pattern of FIG. 4, the use of two nozzles with overlapping spray patterns across the interior surface S again would allow for control of the weight distribution to have a thicker coating on the end portions E and F while not having excessive coating on the central portion D.

It is noted at this point that we make reference to "general" shapes and appearances of some of the features of the spray patterns, because in practice the actual pattern that is applied to the surface will be influenced by many factors, including condition of the nozzle tip, temperatures, air flow and so on. But for purposes of understanding the present inventions and in particular the differences over the prior art spray patterns, it is accurate to state that in general the flat spray patterns 10, 30 each exhibit a generally rectangular drip pattern appearance from having a generally uniform or generally even flow distribution of coating material across the spray pattern, with the embodiment of FIG. 4 further including a reduced flow middle region as compared to the side regions of the spray pattern.

Figure 8:
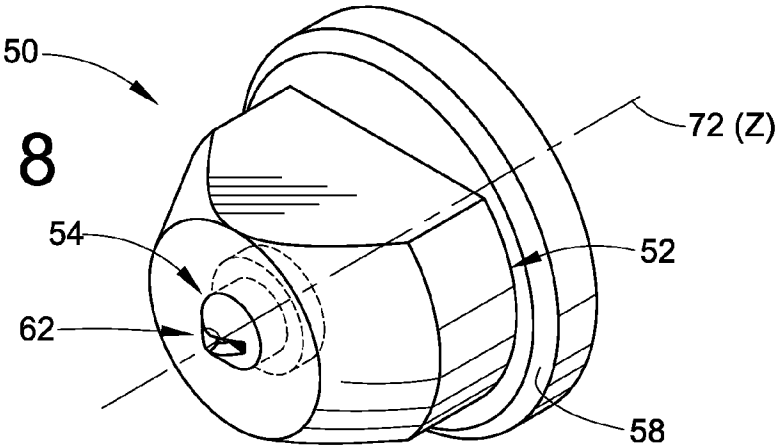
FIG. 8 is an isometric of an exemplary embodiment of a spray nozzle assembly.

With reference to FIG. 8, a nozzle assembly 50 may include a nozzle tip holder 52 and a nozzle tip 54. The nozzle tip holder 52 may include a flange 56 having a shoulder 58 that is clamped against a support surface of a spray gun (not shown). A seal member (not shown) may be provided to provide a fluid tight seal between the nozzle assembly 50 and the flow path for coating material in the spray gun. The nozzle tip 54 also may include a flange 60, with the nozzle tip 54 being typically press fit into the nozzle tip holder 52. The nozzle tip 54 includes an outlet 62, that communicates on the pressurized side of the nozzle assembly 50 with the flow path for coating material from the spray gun. It is the spray orifice design and method of making the spray orifice that is the subject matter of the remaining disclosure and inventive concepts presented herein.

For all the nozzle tip and spray orifice designs illustrated herein, the nozzle tip 54 may include a tapered approach passage 64 (see FIG. 12 for example) on the pressurized or back side of the nozzle tip 54 that terminates in a hemispherical blind bore or dome 66. The nozzle tip 54 thus starts out as an uncut blank with the approach passage 64 and dome 66 formed therein, typically made of tungsten carbide. An spray orifice can then be cut using a round diamond saw DS or cutting wheel that creates an initial groove or V-notch in the front side of the nozzle tip that penetrates the dome 66 to produce an spray orifice (see FIGS. 13 and 15 for examples of the saw DS profile shape as will be further described herein). After the dome 66 is formed, this first cut into the front side of the nozzle tip to create the spray orifice may be made by moving the diamond saw cutting edge CE along the central axis 72 (also denoted as the Z axis herein) with the diamond saw axis of rotation being preferably substantially transverse the nozzle tip central axis 72. The diamond saw DS is also preferably oriented so that the initial or first cut or V-notch is substantially radial with respect to the central axis 72. In general, the deeper the cut into the dome 66, the larger the resultant spray orifice. A nozzle tip having a tapered approach passage 64 prior to cutting the spray orifice is well known and illustrated in U.S. Pat. No. 5,494,226 as well as discussed in U.S. Pat. No. 3,697,313. It is the spray orifice shape and method of cutting that are additional inventive concepts of the present disclosure. The diamond saw DS may have a small radius cutting edge CE formed at the apex of two straight tapered sides TS1 and TS2. The tapered sides TS1 and TS2 form an included angle β. By changing the size of the angle β, the spray orifice size can be changed and the cut groove size changed.

Figure 7A:
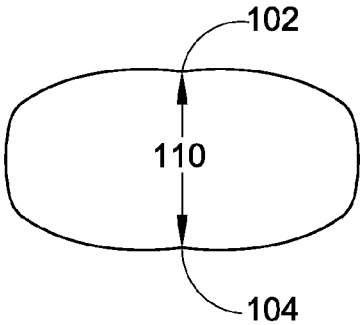
FIG. 7A is an enlarged view of the spray orifice in FIG. 7.
Figure 7:
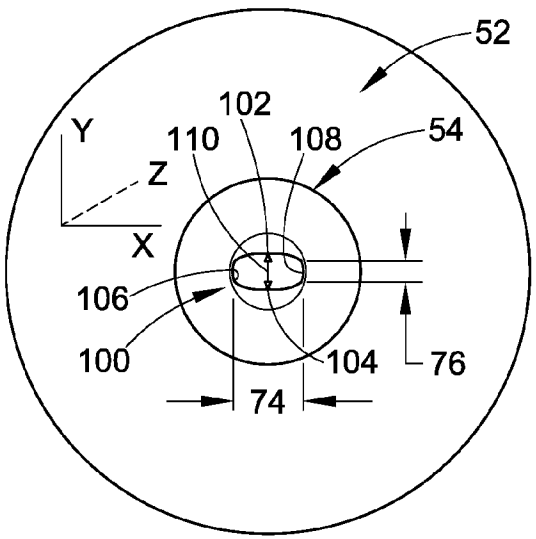
FIG. 7 is another embodiment in front elevation of a spray nozzle having a rectangular cut spray orifice that produces a spray pattern such as illustrated in FIG. 4.
Figure 6:
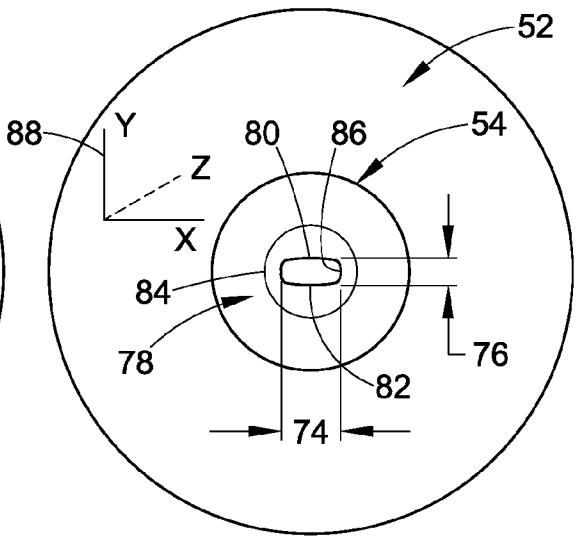
FIG. 6 is a front elevation of a spray nozzle having a rectangular cut spray orifice that produces a spray pattern such as illustrated in FIG. 3.
Figure 5:
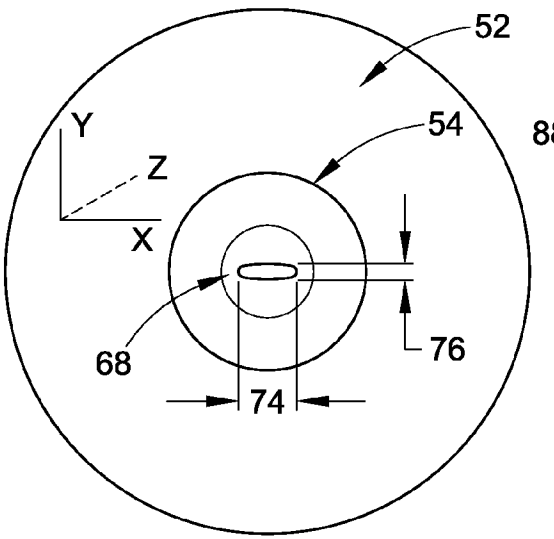
FIG. 5 (PRIOR ART)
FIG. 5 is a front elevation of a prior art nozzle tip and symmetric spray orifice that produces a spray pattern such as illustrated in FIG. 2.

With reference next to FIGS. 5-7, several spray orifice embodiments are illustrated side by side for comparison purposes. For reference purposes we consider the spray orifices to lie in an X-Y plane with the Z axis being the central longitudinal axis 72 of the nozzle tip 54. FIG. 5 is a prior art spray orifice 68. This spray orifice 68 is basically a narrow slit, like a cats-eye shape, when viewed in the plane that the spray orifice lies in (in this case, the X-Y plane of the drawing sheet), and is formed by cutting a single V-notch 70 (FIG. 9) into the nozzle tip 54, with the V-notch 70 cut symmetrically transverse or radial the central axis 72 (FIG. 8) of the nozzle tip 54 (the central axis 72 which corresponds to the reference axis Z may also be viewed as a directional outlet flow axis of the nozzle, although the flat spray pattern spreads out from that axis). The V-notch 70 is thus cut down along the axis 72 to penetrate the dome 66 thereby forming the spray orifice 68. The notch 70 is V-shaped because of the tapered shaped of the diamond saw DS. The spray orifice 68 is generally elliptical because the diamond saw in this embodiment has a small radius edge (a typical radius of about 0.0015 in), such that the width dimension 74 of the spray orifice will depend on how deep the V-notch 70 penetrates the dome 66 for a given size dome 66, and the height dimension 76 will be about the same dimension as the saw edge and a function of the angle β. This symmetrical ellipse spray orifice 68 produces the flat fan prior art spray pattern illustrated in FIG. 2 herein.

FIG. 6 is a first embodiment of an spray orifice 78 in accordance with one or more of the inventive concepts herein. The spray orifice 78 produces the flat spray pattern having generally uniform or even flow distribution across the spray pattern as illustrated in FIG. 3 herein. We refer to this spray orifice 78 as a rectangular cut spray orifice because of its generally rectangular appearance, although the "sides" of the rectangular shape are not necessarily straight sides because the spray orifice is formed by cutting into the dome 66 with a round blade. But there is a distinct and definite rectangular appearance produced by two generally parallel major sides that intersect generally transversely with two generally parallel minor sides, at about right angles of intersection, much like a rectangle (the intersections of the major and minor sides will not necessarily be perfect right angles but rather small radiuses due to the cutting operations). The major sides 80, 82 will have a slight curvature because of the shape of the dome 66, and the minor sides 84, 86 will also have a curvature due to the small radius cutting edge CE of the saw DS, as well as the shape of the dome 66.

Figures 9, 10, 11:
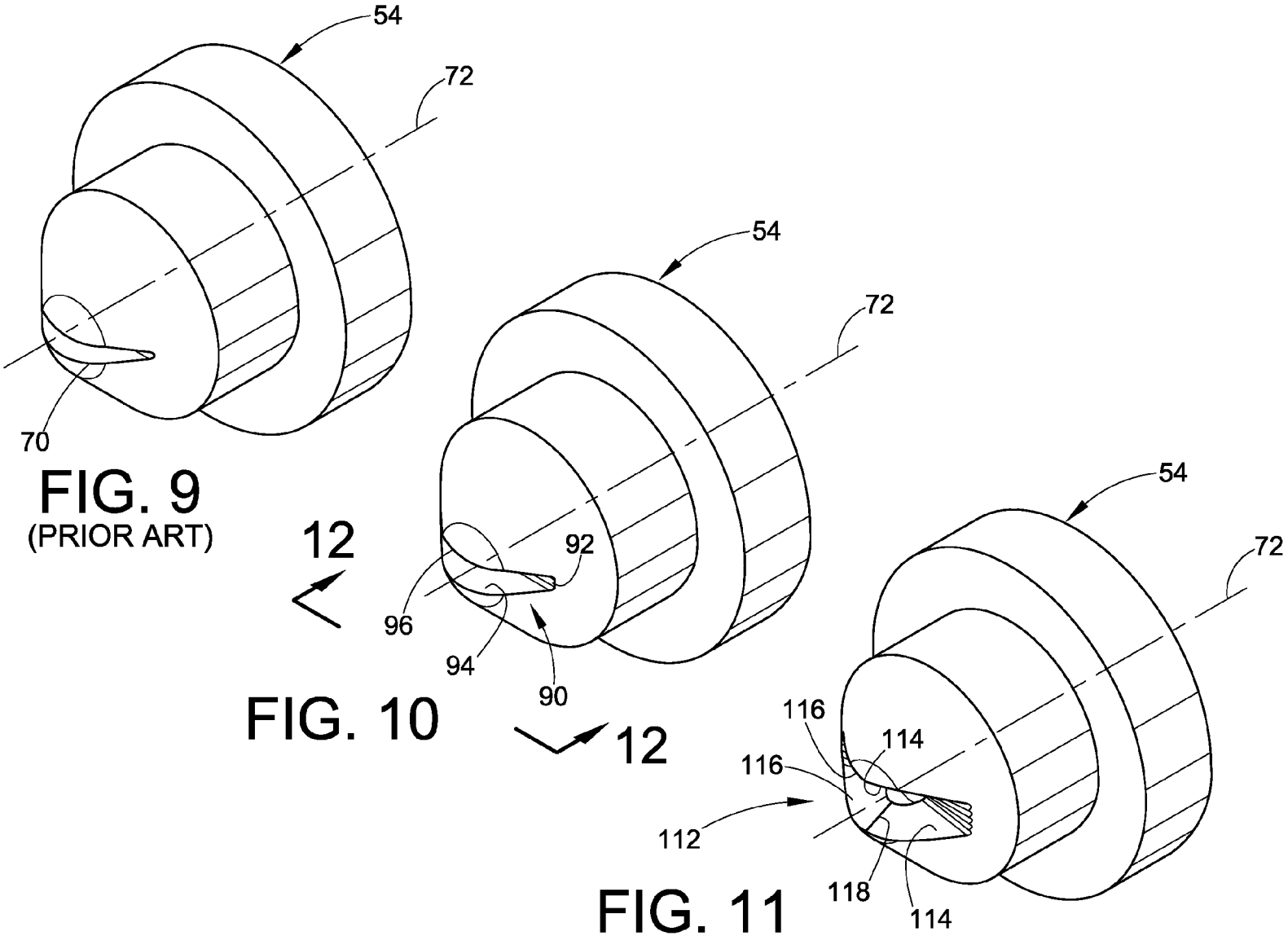
FIG. 9 (PRIOR ART)
FIG. 9 is an isometric of the prior art spray nozzle tip and spray orifice of FIG. 5.
FIG. 10 is isometric of the spray nozzle tip and spray orifice of FIG. 6.
FIG. 11 is n isometric of the spray nozzle tip and spray orifice of FIG. 7.

This spray orifice 78 may be formed by first cutting a V-notch in a manner similar to the V-notch 70 of FIG. 9. Next, the diamond saw is indexed laterally along a transverse axis 88 symmetrically on both sides of the central axis 72 (see FIGS. 10 and 14). Using the XYZ reference noted in FIGS. 5-7, the transverse axis 88 corresponds to the Y axis in terms of direction of the indexed lateral movement of the diamond saw DS after the initial V-notch is formed. In other words, after the initial V-notch is made, the diamond saw is moved laterally in a direction that is perpendicular to the line of cutting for the initial V-notch. The number of additional cuts will be based on the required size of the spray orifice 78, but the effect of these additional lateral cuts across and on both sides of the axis 72 is to "square-up", so to speak, and form the minor sides 84, 86 of the spray orifice 78. This creates the rectangular appearance of the spray orifice 78. The number of additional lateral cuts, in addition to the depth of penetration of the groove 92 (FIG. 10) into the dome 66 and the dimension of the dome 66, will determine the height dimension or minor side dimension 76 of the spray orifice 78. The depth of the groove 92 will determine the major side dimension 74 of the spray orifice 78 for a given size dome 66. As best illustrated in FIG. 13, the additional lateral cuts form in effect (as would appear in cross-section) a trapezoidal groove 90 having a smaller base 92 that lies in a flat plane that is parallel to the axis 88. The side walls 94, 96 of the trapezoid slope away from the base 92 at an angle that is a function of the included angle β of the diamond saw DS. The larger "base" of the trapezoid is of course an imaginary plane since the groove 90 is open at the side opposite the smaller base 92. The spray orifice 78 can thus be thought of as the intersection of the trapezoidal groove 90 penetrating the dome 66 on the approach or front side of the nozzle tip 54.

FIG. 7 illustrates another embodiment of a rectangular cut spray orifice 100. This spray orifice 100 produces the flat spray pattern of FIG. 4 herein. As with the embodiment of FIG. 6, we refer to this spray orifice 100 as a rectangular cut spray orifice because of its generally rectangular appearance, although the "sides" of the rectangular shape are not straight sides because the spray orifice 100 is formed by cutting into the dome 66. Depending on the curvature of the major and minor sides, the spray orifice 100 may also take on a rectangular oval-like appearance. But there is a distinct and definite rectangular appearance produced by two generally parallel major sides that intersect generally transversely with two generally parallel minor sides, at about right angles of intersection, much like a rectangle. The spray orifice 100 has two major sides 102, 104 and two minor sides 106, 108. It will be further noted, however, that each of the major sides 102, 104 also includes an inward taper that results in a generally central constriction 110 of the spray orifice 100 (see also FIG. 7A). This constriction 110 in effect produces the middle region 34 of reduced flow distribution for the spray pattern illustrated in FIG. 4. The height dimension 76 of the minor sides 106, 108 will depend in part on how many cuts and the total angle of rotation the saw is moved to form the additional cuts. Because the saw has a relatively large diameter (3 to 6 in), the minor sides 106, 108 will have a small curvature due to the pivoted movement of the saw as described below.

The central constriction 110 not only reduces the flow distribution of coating material in the middle region of the spray pattern, but also directs more flow to the side regions (such as regions 36 in FIG. 4). The spray pattern is still generally symmetrical and a flat spray pattern. This is because the minor sides 106, 108 are opened up relative to the central area of the spray orifice, thus allowing more flow distribution at the side regions of the spray pattern.

The spray orifice 100 may be formed in the following manner. After an initial cut is made in a manner similar to forming the single slit spray orifice 68 of FIG. 5, rather than indexing the saw laterally either side of the central axis 72, the saw may be pivoted or angularly rotated about the central axis 72. The pivot point of the cutting edge CE will preferably be on the central axis 72 so that no additional material of the nozzle tip is removed at that point (corresponding to the area 110). But by pivoting the saw incrementally clockwise and counterclockwise about the axis 72, the saw will further cut and open up the ends or minor sides 106, 108. The result is a somewhat fan shaped groove 112 on either side of the spray orifice (see FIG. 11), with a constricted central area of the spray orifice 100. The first additional cut may be taken, for example, at five degrees of rotation, and another cut taken at ten degrees of rotation, where zero degrees corresponds to the orientation of the initial cut that is transverse the central axis 72. Then the saw DS may be rotated or pivoted in the opposite direction about the central axis 72 for additional five and ten degree cuts and to maintain symmetry. As illustrated in FIG. 11, the cutting operations produce a slot or groove 112 having two generally planar walls 114, 116 on each side of the groove 112 that meet at an apex 118. This apex 118 corresponds to the central constriction 110.

FIG. 14 represents in a schematic fashion the position of the saw DS during a cutting operation for the rectangular cut spray orifice 100 with a central constriction. The saw DS is pivoted (as represented by the arrow 120) about the central axis 72 in one direction then in the opposite direction through the desired number of degrees to form the spray orifice 100. The pivoting movement and additional cuts are performed after the initial single slit cut is made.

For both embodiments of FIGS. 6 and 7, the spray pattern size and flow distribution may be selected by the overall size and shape of the spray orifices 78, 100 which are a function of the dimensions of the dome 66, the depth of the cuts along the central axis to intersect with the dome 66, the angle dimensions of the pivoting movement of the saw DS for the embodiment of FIG. 7, the size of the included angle β of the saw DS, and the distance of the lateral additional cuts for the embodiment of FIG. 6. For both embodiments, the minor side dimension 76 has a width W and the major side dimension 74 has a length L. In order to produce generally even flow patterns such as illustrated in FIGS. 3 and 4 for example, it is preferred although not required in all cases the $W \geq 0.25L$ or W is equal to or greater than about 0.25 times L. The dimensions W and L are measured from their largest extent (recognizing that the major and minor sides typically may have a curvature characteristic).

Figure 15:
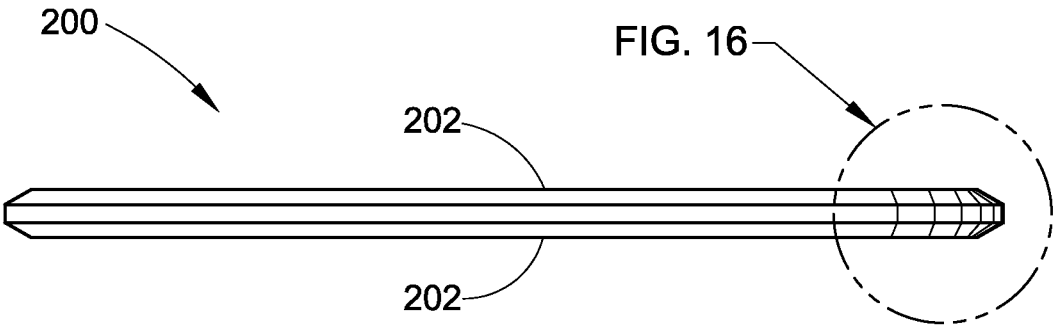
FIG. 15 illustrates a side view of an embodiment of a nozzle tip cutting wheel having a flat cutting edge.
Figure 16:
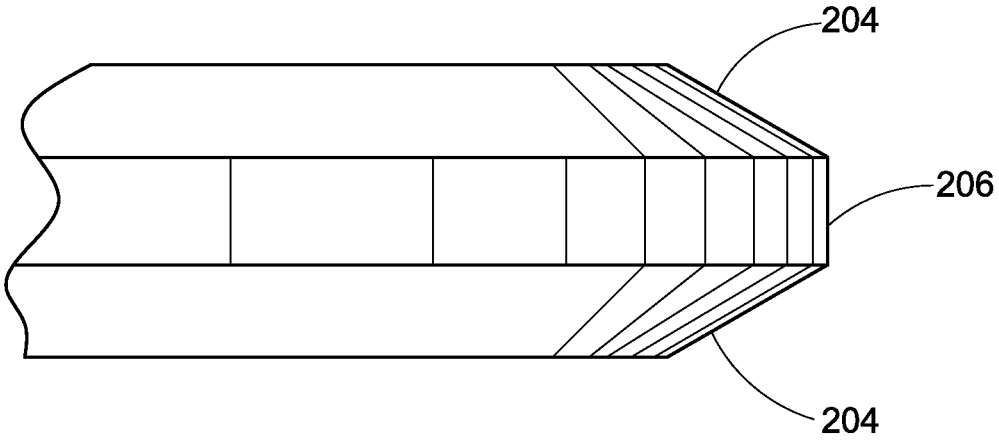
FIG. 16 is an enlarged view of the circled region in FIG. 15.

With reference to FIGS. 15 and 16 we illustrate an alternative embodiment for the diamond saw or cutting wheel. In this embodiment, the cutting wheel 200 includes two generally straight sides 202 that taper inward near the wheel periphery as at 204. But, in contrast to the diamond saw DS described above, the tapered sides do not converge to a narrow apex but rather are truncated to form a flat cutting edge 206. The cutting edge 206 is "flat" in the sense when viewed in cross-section or side elevation as in FIG. 16. In actuality of course the cutting edge 206 is the round outer periphery of the cutting wheel 200. The surfaces 204, 206 thus form a frusto-conical profile.

The cutting wheel 200 may be conveniently used to form the spray orifice 78 of the FIG. 6 embodiment herein. Due to the flat cutting edge 206, a single cut may be used to form the groove 90 and will produce the generally rectangular spray orifice. This single cut avoids the need to have multiple indexed lateral cuts as with the diamond saw DS profile.

The inventions have been described with reference to the exemplary embodiments. Modification and alterations will occur to others upon a reading and understanding of this specification. It is intended to include all such modifications and alterations insofar as they come within the scope of the appended claims or the equivalents thereof.

We claim:

1. A method of coating the interior of an open end cylindrical body with liquid coating material, comprising the steps of:

rotating said open end cylindrical body;

supplying liquid coating material to a spray gun; and spraying liquid coating material from said spray gun through a spray orifice of the spray gun into said open end cylindrical body while said open end cylindrical body is rotating to form a coating on the interior of said open end cylindrical body;

wherein said spray orifice is formed in a nozzle tip body, said nozzle tip body having a hemispherically shaped blind bore on its backside, said spray orifice having been formed on the front side of the nozzle tip body by a cutting wheel having straight sidewalls and a cutting edge between said straight sidewalls, said cutting wheel having been moved to cut into said hemispherically shaped blind bore to form said spray orifice, said spray orifice having two major sides with a first dimension along a first axis and two minor sides with a second dimension along a second axis that is transverse the first axis, said major sides have a length of L and said minor sides have a length of W, and wherein W is greater than or equal to about 0.25 L, each said major side having first and second ends that join with ends of each said minor side at approximately right angles.

2. The method of claim 1 wherein said spray orifice has an outlet flow axis and L>W.

3. The method of claim 1 wherein said major and minor sides comprise curved portions.

4. The method of claim 1 wherein each intersection of a major and minor side is formed by a small radius.

5. The method of claim 1 wherein said spray orifice produces a spray pattern with a generally even distribution of liquid coating material across the spray pattern.

6. The method of claim 1 wherein said spray orifice produces a spray pattern with first and second outer edges.

7. The method of claim 6 wherein said open end cylindrical body has an open top end and a closed bottom end, said top end having a top edge, said bottom end comprising a center, and wherein said spray orifice has an outlet flow axis and said cylindrical body has a longitudinal axis, further comprising the steps of positioning said spray gun so that said outlet flow axis is oriented at an acute angle with respect to said longitudinal axis to cause first outer edge to be aligned with said top edge and said second outer edge to be aligned with said center of said bottom.

8. The method of claim 1 wherein said spray orifice is formed by moving said cutting wheel laterally across said hemispherically shaped blind bore in a direction perpendicular to a central axis of the nozzle tip body.

9. The method of claim 1 wherein said spray orifice is formed during a single cut by said cutting wheel, said cutting wheel having a cutting edge between said straight side walls.

10. The method of claim 1 wherein each said major side comprises an inward taper to produce a central constriction of said spray orifice to produce a spray pattern having a reduced amount of liquid coating material in a central portion of the spray pattern.

11. The method of claim 10 wherein said spray orifice is formed by angular rotation of said cutting wheel about a central axis of the nozzle tip body.

12. A method of coating the interior of an open end cylindrical body with liquid coating material, comprising the steps of:

rotating said open end cylindrical body;

supplying liquid coating material to a spray gun; and spraying coating material from said spray gun through a spray orifice of the spray gun into said open end cylindrical body while said open end cylindrical body is rotating to form a coating on the interior of said open end cylindrical body, wherein said spray orifice is formed in a nozzle tip body, spray orifice comprising two major sides and two minor sides in an X-Y plane that is perpendicular to the outlet flow axis, said major sides being longer than said minor sides, wherein said spray orifice produces a spray pattern with a first outer edge and a second outer edge, and wherein said open end cylindrical body has an open top end and a closed bottom end, said open top end having a top edge, said closed bottom end having a center, and wherein said cylindrical body has a longitudinal axis, further comprising the step of positioning said spray gun so that said outlet flow axis is oriented at an acute angle with respect to said longitudinal axis to cause first outer edge to be aligned with said top edge and said second outer edge to be aligned with said center of said closed bottom end.

13. The method of claim 12 wherein said two major sides have a first dimension along a first axis and said two minor sides have a second dimension along a second axis that is transverse the first axis, said major sides have a length of L and said minor sides have a length of W, and wherein W is greater than or equal to about 0.25 L.

14. The method of claim 12 wherein said spray orifice is formed in a nozzle tip body, said nozzle tip body having a hemispherically shaped blind bore on its backside, said spray orifice having been formed on the front side of the nozzle tip body by a cutting wheel having straight sidewalls and a cutting edge between said straight sidewalls, said cutting wheel having been moved to cut into said hemispherically shaped blind bore to form said spray orifice.

15. A method of coating the interior of an open end cylindrical body with liquid coating material, comprising the steps of:

rotating said open end cylindrical body;

supplying liquid coating material to a spray gun; and spraying liquid coating material from said spray gun through a spray orifice of the spray gun into said open end cylindrical body while said open end cylindrical body is rotating to form a coating on the interior of said open end cylindrical body;

wherein said spray orifice is formed in a nozzle tip body, said nozzle tip body having a hemispherically shaped blind bore on its backside, said spray orifice having been formed on the front side of the nozzle tip body by a cutting wheel having straight sidewalls and a cutting edge between said straight sidewalls, said cutting wheel having been moved to cut into said hemispherically shaped blind bore to form said spray orifice, said spray orifice having two major sides with a first dimension along a first axis and two minor sides with a second dimension along a second axis that is transverse the first axis, said major sides have a length of L and said minor sides have a length of W, and wherein W is greater than or equal to about 0.25 L, each said major side having first and second ends that join with ends of each said minor side at approximately right angles, wherein each said major side comprises an inward taper to produce a central constriction of said spray orifice to produce a spray pattern having a reduced amount of liquid coating material in a central portion of the spray pattern.

16. A method of coating the interior of an open end cylindrical body with liquid coating material, comprising the steps of:

rotating said open end cylindrical body;

supplying liquid coating material to a spray gun; and spraying liquid coating material from said spray gun through a spray orifice of the spray gun into said open end cylindrical body while said open end cylindrical body is rotating to form a coating on the interior of said open end cylindrical body;

wherein said spray orifice is formed in a nozzle tip body, said nozzle tip body having a hemispherically shaped blind bore on its backside, said spray orifice having been formed on the front side of the nozzle tip body by a cutting wheel having straight sidewalls and a cutting edge between said straight sidewalls, said cutting wheel having been moved to cut into said hemispherically shaped blind bore to form said spray orifice, said spray orifice having two major sides with a first dimension along a first axis and two minor sides with a second dimension along a second axis that is transverse the first axis, said major sides have a length of L and said minor sides have a length of W, and wherein W is greater than or equal to about 0.25 L, each said major side having first and second ends that join with ends of each said minor side at approximately right angles;

wherein said spray orifice is formed by angular rotation of said cutting wheel about a central axis of the nozzle tip body.

* * * * *